United States Patent [19]

Kitatani et al.

[11] Patent Number: 4,734,351

[45] Date of Patent: Mar. 29, 1988

[54] LIQUID DEVELOPER FOR ELECTROSTATIC CHARGE IMAGE

[75] Inventors: Katsuji Kitatani; Hiroaki Yokoya; Syu Watarai, all of Kanagawa, Japan

[73] Assignee: Fuji Photo Film Co., Ltd., Kanagawa, Japan

[21] Appl. No.: 913,277

[22] Filed: Sep. 30, 1986

[30] Foreign Application Priority Data

Sep. 30, 1985 [JP] Japan ..... 60-217316
Oct. 1, 1985 [JP] Japan ..... 60-218600

[51] Int. Cl.[4] ..... G03G 9/18
[52] U.S. Cl. ..... 430/114; 430/116
[58] Field of Search ..... 430/114, 137, 116

[56] References Cited

U.S. PATENT DOCUMENTS 4,473,630 9/1984 Yokoya et al. ..... 430/114
4,524,199 6/1985 Lok ..... 526/909

*Primary Examiner*—John L. Goodrow
*Attorney, Agent, or Firm*—Sughrue, Mion, Zinn, Macpeak, and Seas

[57] ABSTRACT

A liquid developer for electrostatic charge images comprising a polymer selected from (a) a polymer containing at least one polymerizable monomer represented by the following general formula (1) as a component of the polymer, and (b) a polymer containing at least one polymerizable monomer represented by the following general formula (2) and chloromethylstyrene a copolymer components, the polymer being dispersed in a carrier liquid having an electric resistance of at least $10^9\Omega$.cm and a dielectric constant of at most 3, (1)

(2)

wherein all the symbols are defined in the specification.

12 Claims, 1 Drawing Figure

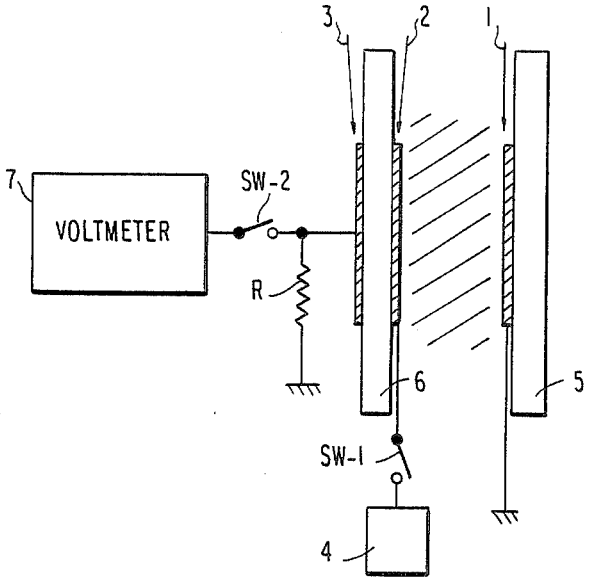
3
2
1
7
VOLTMETER
SW-2
R
6
5
SW-1
4

LIQUID DEVELOPER FOR ELECTROSTATIC CHARGE IMAGE

FIELD OF THE INVENTION

This invention relates to a liquid developer for developing electrostatic charge images formed by an electrostatic photographic process, such as an electrophotographic process, an electrostatic recording process, etc.

BACKGROUND OF THE INVENTION

A liquid developer for electrostatic charge images is generally composed of a dispersion of coloring agent particles such as carbon black, phthalocyanine, etc., in a high insulating low dielectric constant carrier liquid such as an aliphatic hydrocarbon, toluene, a halogenated hydrocarbon, etc. Recently, coloring agent particles having stuck to the surfaces thereof a resin for imparting thereto a charge controlling property, a dispersibility, a fixability, etc., are frequently used as toners for the liquid developer. Also, additives such as a dispersing agent, a polarity controlling agent, etc., are, if necessary, added to the carrier liquid.

As the resins which are ordinarily used for such coloring agents, there are various natural resins and synthetic resins such as resin, natural rubber, an alkyd resin, a phenol resin, an epoxy resin, a pentaerythritol resin, an acryl resin, synthetic rubber, etc. However, the use of these resins has the following problems for practical use. That is, in the case of using a natural resin, it is difficult to obtain products having a constant quality and also in the case of using synthetic resins such as an acryl resin, etc., sufficient dispersibility and fixability are not always obtained and also the coloring agent particles are liable to cause aggregation or sedimentation with the passage of time.

SUMMARY OF THE INVENTION

As a result of various studies for eliminating the above-described disadvantages, the inventors previously found a liquid developer for electrostatic charge images having improved dispersibility and fixability as shown in U.S. Pat. No. 4,473,630 (corresponding to Japanese Patent Application (OPI) No. 105235/83 (the term "OPI" as used herein refers to a "published unexamined Japanese patent application")). Also, as a result of further studies, the inventors have discovered the liquid developer of this invention which has better charging characteristics than those of the previous invention.

A first object of this invention is to improve the dispersibility in a liquid developer for developing electrostatic charge images of a toner composed of a resin itself or a resin and a coloring agent, and to improve the storage stability of the liquid developer in the case of storing for a long period of time.

A second object of this invention is to provide a liquid developer for electrostatic charge images having excellent fixability.

A third object of this invention is to provide a liquid developer for electrostatic charge images excellent in charge stability with the passage of time and stability for repeated use and showing good charge characteristics.

Thus, according to this invention, there is provided a liquid developer for electrostatic charge images comprising a polymer selected from (a) a polymer containing at least one polymerizable monomer represented by the following general formula (1) as a component of the polymer, and (b) a polymer containing at least one polymerizable monomer represented by the following general formula (2) and chloromethylstyrene as a copolymer component, the polymer being dispersed in a carrier liquid having an electric resistance of at least $10^9$ Ω.cm and a dielectric constant of at most 3,

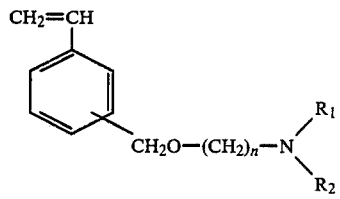

(1)

wherein $R_1$ and $R_2$, which may be the same or different, each represents a hydrogen atom, a substituted or unsubstituted alkyl group, a substituted or unsubstituted aryl group, an aralkyl group, or a heterocyclic group, and $R_1$ and $R_2$ may form a ring with the nitrogen atom, with the ring containing carbon, oxygen, nitrogen or sulfur; the sum of the carbon atom numbers of $R_1$ and $R_2$ is at most 36; and n represents a positive integer of 1 to 6,

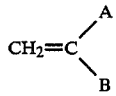

(2)

wherein A represents a hydrogen atom or a methyl group and B represents a group shown by the following general formula (3), (4), (5), (6) or (7)

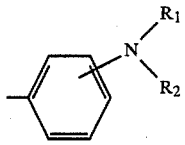

(3)

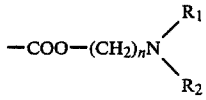

(4)

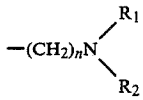

(5)

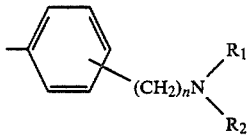

(6)

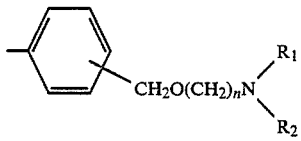

(7)

wherein $R_1$, $R_2$ and n have the same significance as in general formula (1) described above and $R_1$ and $R_2$ may form a ring with the nitrogen atom shown in each of general formulae (3) to (7), with the ring containing carbon, oxygen, nitrogen or sulfur as a constituent element.

BRIEF DESCRIPTION OF THE DRAWING

The FIGURE is an apparatus for measurement of amount of charges used in this invention.

DETAILED DESCRIPTION OF THE INVENTION

The aminoalkyloxymethyl portion of the monomer represented by the above-described general formula (1) may be situated at the ortho-, meta- or para-position of the monomer. The polymer containing the monomer shown by general formula (1) as a component thereof contributes to improvements of the dispersibility, the fixability, and the charge characteristics of the toner particles and, hence, is a component useful for improving the properties of the resin forming the toner particles. In particular, the above-described polymer can be used by itself or with another resin as the resin which forms the toner particles. By using the above-described polymer by itself or with another resin according to this invention, toner particles can be easily formed with a fine particle size and also the dispersibility of the toner particles can be improved. Also, since the melting point of the above-described polymer or resin is relatively low, the fixability of the toner particles having the polymer is improved. Furthermore, since the above-described polymer contains an amino group which is bonded to the main chain of the polymer through a linkage group (generally called a spacer) containing oxygen (and thereby forming an ether) and having high flexibility, the polymer is liable to be ionized, whereby good charge characteristics are obtained.

As is also shown in the comparison examples which will be described hereinafter, the polymer containing at least one kind of the polymerizable monomers represented by general formula (1) described above greatly differs from the alkylaminoalkylstyrene series polymers disclosed in Japanese Patent Application (OPI) No. 105235/83 and the aminoalkyl methacrylate series polymers described in Japanese Patent Application (OPI) No. 95543/84 with respect to improving charge characteristics as described above.

In general formula (1), the alkyl group represented by $R_1$ or $R_2$ preferably contains 1 to 18 carbon atoms. Examples of the alkyl group include a methyl group, an ethyl group, an isopropyl group, a 2-ethylhexyl group and a stearyl group. As substituents for the alkyl group, there are an alkoxyl, alkylthio and monoalkylamino group each containing 1 to 18 carbon atoms, a dialkylamino group containing 2 to 36 carbon atoms, a halogen atom such as a fluorine atom, a chlorine atom or a bromine atom, an aryl, aryloxy and monoarylamino group each containing 6 to 14 carbon atoms, a diacylamino group containing 8 to 28 carbon atoms, and an N-alkyl-N-arylamino group containing 1 to 18 carbon atoms in the alkyl moiety and 6 to 14 carbon atoms in the aryl moiety.

The aryl group represented by $R_1$ or $R_2$ preferably contains 6 to 14 carbon atoms, and examples of them include a phenyl group, a naphthyl group and an anthryl group. As substituents for the aryl group, the same substituents for the alkyl group described above may be applied.

Examples of the aralkyl group include a benzyl group and a phenylethyl group.

Examples of the heterocyclic group include a pyridyl group and a thienyl group.

Examples of the ring formed with $R_1$, $R_2$ and the nitrogen atom include a piperidine ring, a pyrrolidine ring and a morpholine ring.

Examples of the monomers represented by the above-described general formula (1) are N,N-dimethylaminomethoxymethylstyrene, N,N-dimethylaminopropoxymethylstyrene, N,N-dimethylaminobutoxymethylstyrene, N,N-dimethylaminopentoxymethylstyrene, N,N-dimethylaminohexyloxymethylstyrene, aminoethoxymethylstyrene, N,N-diethylaminoethoxymethylstyrene, N,N-dipropylaminoethoxymethylstyrene, N,N-dibutylaminoethoxymethylstyrene, N,N-dihexylaminoethoxymethylstyrene, N,N-dioctylaminoethoxymethylstyrene, N,N-dilaurylaminoethoxymethylstyrene, N,N-distearylaminoethoxymethylstyrene, N-methylaminoethoxymethylstyrene, N-ethylaminoethoxymethylstyrene, N-propylaminoethoxymethylstyrene, N-butylaminoethoxymethylstyrene, N-octylaminoethoxymethylstyrene, N-laurylaminoethoxymethylstyrene, N-ethyl-N-phenylaminoethoxymethylstyrene, N-methyl-N-benzylaminoethoxymethylstyrene, N-ethyl-N-benzylaminoethoxymethylstyrene, morpholinoethoxymethylstyrene, piperidinoethoxymethylstyrene, N-naphthyl-N-ethylaminoethoxymethylstyrene, N-anthryl-N-ethylaminoethoxymethylstyrene, N-phenanthryl-N-ethylaminoethoxymethylstyrene, etc.

The aminoalkyloxymethyl portion in the above compounds may be situated at any position of the ortho-, meta- or para-position of the benzene ring.

As polymers for use in this invention which are based on formula (1), there are a homopolymer of the monomer shown by the above-described general formula (1), and a copolymer of two or more monomers shown by general formula (1). Also, a copolymer of the monomer shown by general formula (1) and other polymerizable monomers, or a graft polymer of the monomer shown by general formula (1) and a polymer having an unsaturated group can be used in this invention. Examples of the polymerizable monomer which can be used as the copolymer with the monomer shown by general formula (1) described above are styrenic monomers such as styrene, vinyltoluene, etc.; acrylic esters such as an acrylic acid alkyl ester, a methacrylic acid alkyl ester, methacrylic acid glycidyl ester, etc.; vinyl esters such as vinyl acetate, vinyl butyrate, vinyl laurate, etc.; and unsaturated carboxylic acids such as acrylic acid, methacrylic acid, etc. Also, examples of the polymer having an unsaturated group, which can be used as the above-described graft polymer with the monomer shown by general formula (1), are unsaturated alkyd, styrenebutadiene rubber, butadiene rubber, cyclized rubber, etc.

The ratio of the monomer shown by general formula (1) described above in the polymer for use in this invention is preferably 1 mol % to 100 mol %, more preferably 10 mol % to 95 mol % with respect to the total mols of the monomer component in the polymer. If the ratio of the monomer shown by general formula (1) is extremely small, the effects of improving the dispersibility, the fixability and charge characteristics are insufficient. Also, the copolymer or the graft polymer of the monomer shown by general formula (1) and other monomer or polymer as described above is also convenient for controlling the flexibility, etc., of the coloring agent particles.

Furthermore, as another embodiment of the polymer for use in this invention, a copolymer of the monomer shown by the above-described general formula (2) and chloromethylstyrene can be used.

Examples of the monomers represented by general formula (2) are N,N-dimethylaminostyrene, N,N-diethylaminostyrene, N,N-dipropylaminostyrene, N,N-dibutylaminostyrene, N,N-dihexylaminostyrene, N,N-dioctylaminostyrene, N,N-dilaurylaminostyrene, N,N-distearylaminostyrene, N-methylaminostyrene, N-ethyl-aminostyrene, N-propylaminostyrene, N-butylaminostyrene, N-octylaminostyrene, N-laurylaminostyrene, N-methyl-N-phenylaminostyrene, N-ethyl-N-phenylaminostyrene, N-methyl-N-benzylaminostyrene, N-ethyl-N-benzylaminostyrene, morpholinostyrene, piperidinostyrene, N-naphthyl-N-ethylaminostyrene, N-anthryl-N-ethylaminostyrene, N-phenanthryl-N-ethylaminostyrene, N,N-dimethylaminoethyl methacrylate, N,N-diethylaminoethyl methacrylate, N,N-dipropylaminoethyl methacrylate, N,N-dimethylallylamine, N,N-diethylallylamine, N,N-dipropylallylamine, N,N-dimethylaminomethylstyrene, N,N-dimethylaminoethylstyrene, N,N-diethylaminomethylstyrene, N,N-dipropylaminomethylstyrene, N,N-dibutylaminomethylstyrene, N,N-dihexylaminomethylstyrene, N,N-dioctylaminomethylstyrene, N,N-dilaurylaminomethylstyrene, N,N-distearylaminomethylstyrene, N-methylaminomethylstyrene, N-ethylaminomethylstyrene, N-propylaminomethylstyrene, N-butylaminomethylstyrene, N-octylaminomethylstyrene, N-laurylaminomethylstyrene, N-methyl-N-phenylaminomethylstyrene, N-ethyl-N-phenylaminomethylstyrene, N-methyl-N-benzylaminomethylstyrene, N-ethyl-N-benzylaminomethylstyrene, morpholinomethylstyrene, piperidinomethylstyrene, N-naphthyl-N-ethylaminomethylstyrene, N-anthryl-N-ethylaminomethylstyrene, N-phenanthryl-N-ethylaminomethylstyrene, N,N-dimethylaminomethoxymethylstyrene, N,N-dimethylaminoethoxymethylstyrene, N,N-dimethylaminopropoxymethylstyrene, N,N-dimethylaminobutoxymethylstyrene, N,N-dimethylaminopentoxymethylstyrene, N,N-dimethylaminohexyloxymethylstyrene, aminoethoxymethylstyrene, N,N-diethylaminoethoxymethylstyrene, N,N-dipropylaminoethoxymethylstyrene, N,N-dibutylaminoethoxymethylstyrene, N,N-dihexylaminoethoxymethylstyrene, N,N-dioctylaminoethoxymethylstyrene, N,N-dilaurylaminoethoxymethylstyrene, N,N-distearylaminoethoxymethylstyrene, N-methylaminoethoxymethylstyrene, N-ethylaminoethoxymethylstyrene, N-propylaminoethoxymethylstyrene, N-butylaminoethoxymethylstyrene, N-octylaminoethoxymethylstyrene, N-laurylaminoethoxymethylstyrene, N-methyl-N-phenylaminoethoxymethylstyrene, N-ethyl-N-phenylaminoethoxymethylstyrene, N-methyl-N-benzylaminoethoxymethylstyrene, N-ethyl-N-benzylaminoethoxymethylstyrene, morpholinoethoxymethylstyrene, piperidinoethoxymethylstyrene, N-naphthyl-N-ethylaminoethoxymethylstyrene, N-anthryl-N-ethylaminoethoxymethylstyrene, N-phenanthryl-N-ethylaminoethoxymethylstyrene, etc.

Also, the above-described copolymer may further contain another polymerizable monomer as a third component, or a graft polymer of the abovedescribed copolymer and a polymer having an unsaturated group can be used in this invention. In the case of the copolymer of the monomer of general formula (2) which further contains another polymerizable monomer as the third component, examples of the other polymerizable monomer are styrenic monomers such as styrene, vinyltoluene, etc., acrylic esters such as an acrylic acid alkyl ester, a methacrylic acid alkyl ester, a methacrylic acid glycidyl ester, etc., vinyl esters such as vinyl acetate, vinyl butyrate, vinyl laurate, etc., and unsaturated carboxylic acids such as acrylic acid, methacrylic acid, etc. Examples of the polymer having an unsaturated group are unsaturated alkyd, styrene-butadiene rubber, butadiene rubber, cyclized rubber, etc.

The ratio of the polymerizable monomer shown by general formula (2) described above in the polymer for use in this invention is preferably 1 mol % to 99 mol %, more preferably 10 mol % to 95 mol % with respect to the total mols of the monomer component in the polymer. If the ratio of the monomer of general formula (2) is extremely small, the effects for improving the dispersibility, fixability and charge characteristics become insufficient.

The ratio of chloromethylstyrene depends upon the kind of the monomer shown by general formula (2) described above, but is preferably 1 mol % to 10 mol %, more preferably 3 mol % to 7 mol % with respect to the mols of polymerizable monomer of general formula (2). If the proportion of chloromethylstyrene in the polymer is too small, the effects for improving charge characteristics become insufficient. On the other hand, if the proportion of chloromethylstyrene is over the above-described range, the polymer is liable to cause gelation to reduce the dispersibility of the coloring agent particles.

It is preferred to introduce the above-described third component into the copolymer of at least one of the polymerizable monomers shown by general formula (2) and chloromethylstyrene, since in such a case the fixability, etc., of coloring agent particles can be controlled.

There is no particular restriction on the molecular weight of the polymer for use in this invention if it is in the range that the polymer is not completely dissolved in the carrier liquid. By employing conventional polymerization methods, a polymer having a molecular weight of about $10^3$ to $10^5$ is easily obtained, and the objects of this invention can be sufficiently attained by using a polymer having the above-described molecular weight. Also, in this invention, the polymer containing the monomer represented by the above-described general formula (1) or (2) as a component may be solely used as the resin for forming the toner for the liquid developer, but other resins which are insoluble in or swelled by the carrier liquid for the liquid developer of this invention can be used together with the above-described polymer of this invention to form the toner. Examples of such other resins are natural or synthetic resins such as an alkyd resin, a natural resin-modified phenol resin, polyterpene, a natural resin-modified maleic acid resin, a natural resin-modified pentaerythritol resin, a rosin series resin, a styrene resin, an acrylic resin, a butadiene rubber, a sthrene-butadiene rubber, a natural rubber, etc. The aforesaid resin is used as a mixture with the polymer containing the monomer shown by the above-described general formulae (1) and (2) as a component, and there is no particular restriction about the mixing ratio thereof if it is in the range of obtaining the effects of the improvements of the dispersibility, fixability, and charge characteristics of the toner by the polymer. The proper amount of the aforesaid resin depends upon the natures of the polymer used and the resin, but is usually 0.01 to 100 parts by weight to 1 part by weight of the polymer.

There is no particular restriction on the process of producing the polymer for use in this invention and various processes can be used for the production thereof. In other words, if a homopolymer of the monomer shown by the above-described general formula (1) or (2) or a copolymer containing the monomer of general formula (1) or (2) described above as a polymer component is obtained as the product, any polymerization method may be employed. As the polymerization method, a solution polymerization method, a suspension polymerization method, etc., can be employed.

As the carrier liquid or medium having an electric resistance of above $10^9$ Ω.cm and a dielectric constant of at most 3 for use in this invention, there are aliphatic hydrocarbon solvents (e.g., hexane, heptane or octane), alicyclic hydrocarbon solvents (e.g., cyclohexane, methylcyclohexane or decalin), aromatic hydrocarbon solvents (e.g., benzene or toluene), halogenated hydrocarbon solvents (e.g., methylene chloride, chloroform or tetrachloromethane), etc. From the viewpoints of volatility, safety, non-toxicity, non-odoring property, etc., isoparaffinic petroleum solvents are suitable in this invention. As examples of such isoparaffinic petroleum solvents, there are Isopar G, Isopar H, Isopar L, etc., trade names, made by Esso Research and Engineering Co.

The liquid developer of this invention does not necessarily contain a coloring agent but for visualizing the images after development, a coloring agent can be incorporated in the toner particles. As examples of such a coloring agent, known pigments and/or dyes which are ordinarily used for liquid developers can be used in this invention. Examples of suitable coloring agent are Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victorian Blue (C.I. 42595-Lake), Sorit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415), carbon black, etc.

The compounding ratio of the coloring agent for the coloring agent particles and the resin containing the polymer having the monomer shown by the above-described general formulae (1) and (2) as a component can be optionally selected in this invention but, in general, the proportion of the resin is 0.01 to 100 parts by weight, preferably 0.1 to 10 parts by weight, per 1 part by weight of the coloring agent.

The toner which can be used for the liquid developer of this invention can be prepared by a conventional method. Examples of the production method for the toner containing a coloring agent are shown below.

First, a coloring agent composed of a pigment and/or a dye and the above-described polymer or a resin containing the polymer for forming toner particles are kneaded in a solvent for the polymer or the resin using a kneader such as a ball mill, a roll mill, a paint shaker, etc., and then the solvent is removed by heating, etc., to provide mixture.

Alternatively, the above-described kneaded mixture is poured in a liquid which does not dissolve the polymer or the resini followed by reprecipitation to provide a mixture.

Alternatively, a coloring agent and the polymer or a resin containing the polymer are kneaded using a kneader such as a ball mill, a roll mill, etc., while heating them to a temperature higher than the melting point of the polymer or resin and then cooled to provide a mixture.

The mixture thus obtained is dry-ground and/or wet-ground to provide coloring agent particles. In the case of using the resin containing the above-described polymer, toner particles having fine particle size can be easily obtained. The particle sizes of the toner particles are usually 1 to 0.05 μm in this invention.

Also, the toner particles for use in this invention may be further prepared by any other method if coloring material particles are finally obtained from a coloring agent and the above-described polymer or the polymer-containing resin without being restricted to the above-described methods.

The liquid developer for electrostatic charge images of this invention is obtained by dispersing the toner particles thus obtained in the above-described carrier liquid. There is no particular restriction on the concentration of the toner in the developer but it is usually 0.001 g to 100 g, preferably 0.01 g to 10 g, per liter of the carrier liquid or medium.

In this invention, ordinary additives such as a dispersing agent, a charge controlling agent, etc., can be added to the liquid developer as in conventional liquid developers for further improving the dispersibility of the toner particles, controlling charges of the toner particles in the developer, etc.

The dispersing agent which can be used is a resin which is dissolved in or swelled by the carrier liquid having a high electric resistance, which is used for the liquid developer of this invention, and can increase the dispersibility of the toner particles. Examples of the dispersing agent are synthetic rubbers such as a styrene-butadiene rubber, a vinyltoluenebutadiene rubber, a butadiene-isoprene rubber, etc.; long chain acrylic or methacrylic resins and copolymers of long chain acrylic or methacrylic compounds and other polymerizable monomers, such as a polymer of 2-ethylhexyl methacrylate, lauryl methacrylate, stearyl methacrylate, lauryl acrylate or octyl acrylate, a styrene-lauryl methacrylate copolymer, an acrylic acid-lauryl methacrylate copolymer, etc.; polyolefins such as polyethylene, etc.; polyterpenes, etc., can be used. Other dispersing agents useful in this invention are the polymers containing a quaternary ammonium salt monomer disclosed in Japanese Patent Application (OPI) No. 31739/79.

The charge controlling agent which can be used is a material which contributes to electrostatically charging the toner particles and examples of such a charge controlling agent are metal salts of fatty acids such as naphthenic acid, octenic acid, oleic acid, stearic acid, isostearic acid, lauric acid, etc.; metal salts of sulfosuccinic acid esters; the oil-soluble sulfonic acid metal salts described in Japanese Patent Publication No. 556/70, Japanese Patent Application (OPI) Nos. 37435/77, 37049/77, etc.; the metal salts of phosphoric acid esters described in Japanese Patent Publication No. 9594/70; the metal salts of abietic acid or hydrogenated abietic acid described in Japanese Patent Publication No. 25666/73; the calcium salts of alkylbenzenesulfonic acid described in Japanese Patent Publication No. 2620/80; the metal salts of aromatic carboxylic acids or sulfonic acids described in Japanese Patent Application (OPI) Nos. 107837/77, 38937/77, 90643/77, 139753/77, etc.;

nonionic surface active agents such as polyoxyethylated alkylamine, etc.; oils and fats such as lecithin, linseed oil, etc.; polyvinylpyrrolidone; organic acid esters of polyhydric alcohols; the oil-soluble phenol resins described in Japanese Patent Publication No. 3716/71; the acid ester series surface active agents described in Japanese Patent Application (OPI) No. 210345/82; and the sulfonic acid resins described in Japanese Patent Publication No. 24994/81.

The use of the above-described metal salts as the charge controlling agent is particularly convenient since by the addition of the charge controlling agent to the liquid developer of this invention, a developer which contains clearly positively charged toner particles is obtained.

The liquid developer of this invention can be used for light-sensitive elements using an organic photoconductor or an inorganic photoconductor. Also, the liquid developer of this invention can be used for developing electrostatic latent images formed by other means than light exposure, for example, latent images formed on a dielectric substance by means of an electrification stylus.

As the organic photoconductor, various materials well known in the field of art can be used. Practical examples are described in, for example, the report entitled "Electrophotographic Elements, Materials and Process" in *Research Disclosure,* No. 10938, May, 1973, page 61 et seq.

Specific examples of the organic photoconductors which can be used in practice are an electrophotographic photosensitive element composed of poly-N-vinylcarbazole and 2,4,7-trinitrofluoren-9-one as described in U.S. Pat. No. 3,484,239, an electrophotographic photosensitive element prepared by sensitizing poly-N-vinylcarbazole with a pyrylium salt series dye as described in Japanese Patent Publication No. 25658/73, an electrophotographic photosensitive element containing an organic pigment as the main component as described in Japanese Patent Application (OPI) No. 37543/72, and an electrophotographic photosensitive element containing an eutectic complex composed of a dye and a resin as described in Japanese Patent Application (OPI) No. 10785/72.

Various inorganic compounds disclosed in R. M. Schaffert, *Electrophotography,* pages 260–274, published by Focal Press (London) (1975) can be used as the inorganic photoconductors. Specific examples of the inorganic photoconductor are zinc oxide, zinc sulfide, a cadmium sulfide, selenium, a selenium-tellurium alloy, a selenium-arsenic alloy, a selenium-tellurium-arsenic alloy, etc.

Synthesis examples of the polymer for use in this invention are shown below, but this invention is not limited to these examples.

SYNTHESIS EXAMPLE 1

Synthesis of Polymerizable Monomer Shown by General Formula (1)

In 200 g of 2-dimethylaminoethanol was dissolved 79 g of potassium hydroxide (content of 85 wt %) and 153 g of chloromethylstyrene (a mixture of the meta and para-compounds) was added dropwise to the solution with stirring at 70° C. After further continuing stirring for 3 hours at 60° to 70° C., 500 ml of water was added to the reaction mixture and the organic layer formed was extracted with 500 ml of toluene. After drying the toluene extract thus obtained with anhydrous sodium sulfate, 1 g of di-tert-butyl catechol was added thereto and the mixture was concentrated and distilled under reduced pressure to provide 97.8 g of dimethylaminoethoxymethylstyrene (b.p.: 104° to 116° C./0.5 to 0.7 mm Hg, colorless liquid).

SYNTHESIS EXAMPLE 2

Synthesis of Polymer Composed of Polymerizable Monomer Shown by General Formula (1)

In a 300 ml glass vessel equipped with a stirrer, a reflux condenser, and an inlet for nitrogen were placed 28.7 g of styrene monomer, 24.2 g of the monomer prepared in Synthesis Example 1, 346 mg of azobisisobutyronitrile, and 75 g of toluene. The polymerization was performed for 8 hours at 80° C. with stirring under a nitrogen stream to provide a solution containing a copolymer. The solution was poured into 2.5 l of methanol and the white copolymer thus precipitated was collected and dried under reduced pressure using a vacuum pump. The polymer thus obtained was dissolved in 100 g of chloroform, the solution was poured into 2.5 l of methanol to reprecipitate the polymer, and the polymer was dried as above to provide 8.5 g of the white powdery polymer. The ratio of the monomer obtained in Example 1 in the copolymer thus obtained was 25 mol %.

SYNTHESIS EXAMPLES 3 TO 7

Synthesis of Polymer Composed of Polymerizable Monomer Shown by General Formula (1)

By the same manner as in Synthesis Example 2, the polymers shown in Table 1 were prepared.

TABLE 1

| Synthesis Example | Monomer 1 | Monomer 2 | Amount of Monomer 1 in Polymer (mol %) |
|---|---|---|---|
| 3 | Monomer of Example 1 | — | 100 |
| 4 | Monomer of Example 1 | Methyl Methacrylate | 25 |
| 5 | Monomer of Example 1 | Butyl Methacrylate | 27 |
| 6 | Monomer of Example 1 | Butyl Methacrylate | 46 |
| 7 | Monomer of Example 1 | Methoxyethoxyethoxy Methacrylate | 50 |

SYNTHESIS EXAMPLES 8 AND 9

For comparison, the copolymers shown in Table 2 were prepared by the same manner as in Synthesis Example

TABLE 2

| Synthesis Example | Monomer 1 | Monomer 2 | Amount of Monomer 1 in Polymer (mol %) |
|---|---|---|---|
| 8 | $(CH_3)_2NCH_2CH_2OCOCCH_3{=}CH_2$ | Styrene | 25 |
| 9 | $(CH_3)_2NCH_2{-}(C_6H_4){-}CH{=}CH_2$ | Styrene | 30 |

SYNTHESIS EXAMPLE 10

Synthesis of Copolymer of Monomer Shown in General Formula (2) and Chloromethylstyrene In a 300 ml glass vessel equipped with a stirrer, a reflux condenser, and an inlet for nitrogen were placed 28.7 g of styrene monomer, 22.3 g of diethylaminomethylstyrene, 0.6 g of chloromethylstyrene, 346 mg of azobisisobutyronitrile, and 75 g of toluene. The copolymerization was performed for 8 hours at 80° C. with stirring under a nitrogen stream to provide a solution containing a copolymer. The solution was poured into 2.5 l of methanol and the white polymer thus precipitated was collected and dried at room temperature under reduced pressure using a vacuum pump. The copolymer thus obtained was dissolved in 100 g of chloroform, 2.5 l of methanol was added to the solution to reprecipitate the copolymer, and the product was dried as described above to provide 21.3 g of the purified white powdery copolymer.

SYNTHESIS EXAMPLES 11 TO 16

Synthesis of Copolymer of Polymerizable Monomer shown by General Formula (2) and Chloromethylstyrene By the same manner as in Synthesis Example 10, the copolymers shown in Table 3 below were prepared.

TABLE 3

| Synthesis Example | Monomer 1 | Monomer 2 | Monomer 3 | Copolymerization* ratio |
|---|---|---|---|---|
| 11 | 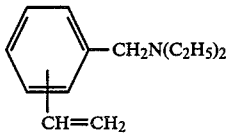 | Styrene | Chloromethylstyrene | 3/7/0.2 |
| 12 | " | " | " | 3/7/0.3 |
| 13 | " | " | " | 5/5/0.1 |
| 14 | " | Methyl Methacrylate | " | 3/7/0.1 |
| 15 | 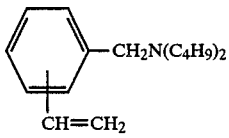 | Styrene | " | 3/7/0.1 |
| 16 | $(CH_3)_2NCH_2CH_2OCO\overset{CH_3}{\overset{\vert}{C}}{=}CH_2$ | Methyl Methacrylate | " | 3/7/0.1 |

*Monomer 1/Monomer 2/Monomer 3

SYNTHESIS EXAMPLES 17 TO 19

For comparison, the copolymers shown in Table 4 below were prepared by the same manner as in Synthesis Example 11.

TABLE 4

| Synthesis Example | Monomer 1 | Monomer 2 | Amount of Monomer 1 in Polymer (mol %) |
|---|---|---|---|
| 17 | $(CH_3)_2NCH_2CH_2OCOCCH_3{=}CH_2$ | Styrene | 25 |
| 18 | $(C_2H_5)_2NCH_2{-}(C_6H_4){-}CH{=}CH_2$ | Styrene | 30 |
| 19 | Chloromethylstyrene | Styrene | 27 |

TABLE 4-continued

This invention will now be explained in more detail by the following examples using the polymer containing at least one of the polymerizable monomers shown by general formula (1) described above as a component thereof, but this invention is not limited to these examples.

EXAMPLE 1

Together with 17.3 parts by weight of toluene and 70 parts by weight of glass beads, 3.5 parts by weight of carbon black (Mitsubishi +40, trade name, made by Mitsubishi Chemical Industries Ltd.) as a pigment and 3.5 parts by weight of the copolymer obtained in Synthesis Example 2 described above as a copolymer containing aminoalkyloxymethylstyrene were mixed by a paint shaker (made by Toyo Seiki K.K.) for 90 minutes. The resulting mixture, except for the glass beads, was poured into Isopar H, trade name, made by Esso Research and Engineering Co.), and the precipitates thus formed were collected by filtration. 1 Part by weight of the precipitates thus obtained was mixed with 10 parts by weight of Isopar H solution containing 5% by weight Solprene 1205 (styrene-butadiene rubber, trade name, made by Asahi Chemical Industry Co., Ltd.), and the resulting mixture was mixed together with 25 parts by weight of glass beads by a paint shaker for 90 minutes. Then, 4 parts by weight of the dispersion thus obtained was diluted with 100 parts by weight of Isopar H containing $10^{-4}$ mol/liter of zirconium naphthenate to provide Liquid Developer No. 1 for electrostatic charge images. The liquid developer thus obtained showed clear positive polarity and also showed excellent dispersibility and fixability. The charged amount of the liquid developer was measured using the apparatus disclosed in Japanese Patent Application (OPI) No. 21056/85 (corresponding to European Pat. No. 0132718 and U.S. patent application Ser. No. 631,114, filed on July 16, 1984. The details of the apparatus and the process for measurement are as follows.

Measurement of Amount of Charges

The toner is inserted into a condenser formed by parallel electrode plates as shown in the figure. In the FIG. 1, 2 and 3 show electrode, 4 shows electric source, 5 and 6 show electric insulator, 7 shows voltmeter, SW-1 and SW-2 show switch, and R shows resistance. After the condenser is electrically charged for a short time, the decay rate of the surface charge is measured, by which measurement can be carried out in a state approaching that of the actual development. The value to be measured is a decay rate of surface charge (mV/sec), which corresponds to the amount of charge on the toner. The conditions of measurement are shown in the following.

Conditions for Measuring the Amount of Charge

The surface area of each electrode: 9 $cm^2$,
the interval between electrodes 1 and 2: 1.8 mm,
the interval between electrodes 2 and 3: 25 cm,
and the capacity between the electrodes: 1,200 PF,
the voltage of the electric source $\beta$: 500 v, and resistance R=50 K Ω.

The results obtained are shown in Table 5 below.

EXAMPLE 2

By following the same procedure as in Example 1, except that the polymers prepared in Synthesis Examples 3 to 7 described above were used in place of the copolymer obtained in Synthesis Example 2 used in Example 1, Liquid Developer Nos. 2 to 6 having good dispersibility, fixability and charge characteristics were prepared. The measurement results of the charged amounts thereof are shown in Table 5.

COMPARISON EXAMPLE 1

By following the same procedure as in Example 1 using the copolymers obtained in Synthesis Examples 8 and 9 (comparison examples), Comparison Liquid Developer Nos. 7 and 8 were obtained. The measurement results of the charged amounts of them are shown in Table 5 below.

TABLE 5

| Liquid Developer No. | Polymer Used | Polarity of Charge | Charged Amount (mV/sec) |
|---|---|---|---|
| 1 | Polymer of Synthesis Example 2 | ⊕ | 12 |
| 2 | Polymer of Synthesis Example 3 | ⊕ | 20 |
| 3 | Polymer of Synthesis Example 4 | ⊕ | 14 |
| 4 | Polymer of Synthesis Example 5 | ⊕ | 13 |
| 5 | Polymer of Synthesis Example 6 | ⊕ | 15 |
| 6 | Polymer of Synthesis Example 7 | ⊕ | 15 |
| 7 | Polymer of Synthesis Example 8 | ⊕/⊖ | 6 |
| 8 | Polymer of Synthesis | ⊕/⊖ | 5 |

TABLE 5-continued

| Liquid Developer No. | Polymer Used | Polarity of Charge | Charged Amount (mV/sec) |
|---|---|---|---|
| | Example 9 | | |

Liquid Developer Nos. 1 to 6: Samples of this invention
Liquid Developer Nos. 8 and 9: Comparison samples.

As is clear from the results shown in Table 5 above, Liquid Developer Nos. 1 to 6 of this invention each shows a clear positively charging property and has a sufficient charge amount. On the other hand, in Comparison Liquid Developer Nos. 7 and 8, the polarity of the charge is indistinct and the charged amount is insufficient, whereby the toner particles are liable to cause aggregation and sedimentation.

Example of this invention using the copolymer containing the monomer shown by general formula (2) described above and chloromethylstyrene as the copolymer components are shown below.

EXAMPLE 3

Together with 17.3 parts by weight of toluene and 70 parts by weight of glass beads, 3.5 parts by weight of carbon black (Mitsubishi #40, trade name, made by Mitsubishi Chemical Industries Ltd.) as pigment and 3.5 parts by weight of the copolymer prepared in Synthesis Example 10 were mixed for 90 minutes by a paint shaker (made by Toyo Seiki K.K.) and the mixture, except the glass beads, was poured into Isopar H to form precipitates (14 parts by weight), which were collected by filtration. 1 Part by weight of the precipitates thus obtained were mixed with 10 parts by weight of Isopar H solution containing 5% by weight of Solprene 1205 and they were mixed together with 25 parts by weight of glass beads for 90 minutes by a paint shaker. Then, 4 parts by weight of the above-described dispersion was diluted with 100 parts by weight of Isopar H containing $10^{-4}$ mol/liter of zirconium naphthenate to provide Liquid Developer No. 9 for electrostatic charge. The developer thus obtained showed a clear positively charging property and also showed excellent dispersibility and fixability. Then, the charged amount of the liquid developer was measured using the apparatus disclosed in Japanese Patent Application (OPI) No. 21056/85. The results obtained are shown in Table 6 below.

EXAMPLE 4

By following the same procedure as in Example 3, except that the polymers prepared in Synthesis Examples 11 to 16 were used in place of the copolymer prepared in Synthesis Example 1 used in Example 3, Liquid Developer Nos. 10 to 15 showing good dispersibility, fixability and charge characteristics were obtained. The measurement results of the charged amounts thereof are shown in Table 6 below.

COMPARISON EXAMPLE 2

By following the same procedure as in Example 3 using the copolymers prepared in Synthesis Examples 17 to 19 (comparison examples), Comparison Liquid Developer Nos. 16 to 18 were obtained. The measurement results of the charged amounts are shown in Table 6 below.

TABLE 6

| Liquid Developer No. | Polymer Used | Polarity of Charge | Charged Amount (mV/sec) |
|---|---|---|---|
| 9 | Polymer of Synthesis Example 10 | + | 18 |
| 10 | Polymer of Synthesis Example 11 | + | 19.5 |
| 11 | Polymer of Synthesis Example 12 | + | 8 |
| 12 | Polymer of Synthesis Example 13 | + | 15 |
| 13 | Polymer of Synthesis Example 14 | + | 18.5 |
| 14 | Polymer of Synthesis Example 15 | + | 16 |
| 15 | Polymer of Synthesis Example 16 | + | 13 |
| 16 | Polymer of Synthesis Example 17 | +/− | 6 |
| 17 | Polymer of Synthesis Example 18 | +/− | 1 |
| 18 | Polymer of Synthesis Example 19 | +/− | 5 |

Liquid Developer Nos. 9 to 15: Samples of this invention
Liquid Developer Nos. 16 to 18: Comparison samples As is clear from the results shown in Table 6 above, Liquid Developer Nos. 9 to 15 of this invention show a clear positive charging property and have sufficient charged amount. On the other hand, in Comparison Liquid Developer Nos. 16 to 18, the polarity of the charges is indistinct, the charged amount is insufficient, and the toner particles are liable to cause aggregation and sedimentation.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic charge images comprising a polymer selected from (a) a polymer containing at least one polymerizable monomer represented by the following general formula (1) as a component of the polymer, and (b) a polymer containing at least one polymerizable monomer represented by the following general formula (2) and chloromethylstyrene as copolymer components, the polymer being dispersed in a carrier liquid having an electric resistance of at least $10^9$ Ω.cm and a dielectric constant of at most 3,

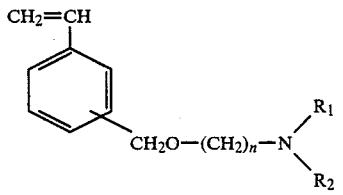

(1)

wherein $R_1$ and $R_2$, which may be the same or different, each represents a hydrogen atom, a substituted or unsubstituted alkyl group, a substituted or unsubstituted aryl group, an aralkyl group or a heterocyclic group, said $R_1$ and $R_2$ may form a ring with the nitrogen atom, said ring may contain carbon, oxygen, nitrogen or sulfur as a constituent element, the sum of the carbon atom numbers of $R_1$ and $R_2$ is at most 36; and n represents a positive integer of 1 to 6,

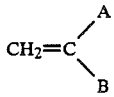

(2)

wherein A represents a hydrogen atom or a methyl group and B represents a group shown by the following general formula (3), (4), (5), (6) or (7),

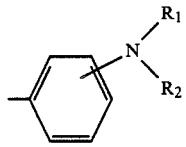

(3)

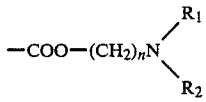

(4)

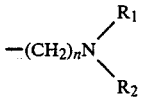

(5)

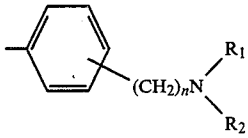

(6)

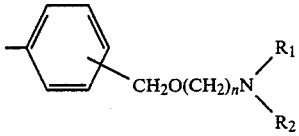

(7)

wherein $R_1$ and $R_2$ have the same significance as defined in general formula (1), and said $R_1$ and $R_2$ may form a ring with the nitrogen atom shown in each of general formulae (3), (4), (5), (6) and (7), and the ring may contain carbon, oxygen, nitrogen, or sulfur as a constituent element.

2. The liquid developer as claimed in claim 1, wherein said polymer forms toner particles by itself.

3. The liquid developer as claimed in claim 1, wherein said polymer forms toner particles with a coloring agent.

4. The liquid developer as claimed in claim 1, wherein said polymer forms toner particles with another resin.

5. The liquid developer as claimed in claim 4, wherein said another resin is selected from an alkyd resin, a natural resin-modified phenol resin, polyterpene, a natural resin-modified maleic acid resin, a natural resin-modified pentaerythritol resin, a rosin series resin, a styrene resin, an acrylic resin, a butadiene rubber, a styrene-butadiene rubber and a natural rubber.

6. The liquid developer as claimed in claim 4, wherein the amount of said another resin is 0.01 to 100 parts by weight to 1 part by weight of the polymer.

7. The liquid developer as claimed in claim 1, wherein the polymer which contains the polymerizable monomer of general formula (1) contains from 1 to 100 mol % of said monomer with respect to the total mols of the monomer component in the polymer.

8. The liquid developer as claimed in claim 1, wherein the polymer which contains the polymerizable monomer of general formula (1) contains from 10 to 95 mol % of said monomer with respect to the total mols of the monomer component in the polymer.

9. The liquid developer as claimed in claim 1, wherein the polymer which contains the polymerizable monomer of general formula (2) contains from 1 to 99 mol % of said monomer with respect to the total mols of the monomer component in the polymer.

10. The liquid developer as claimed in claim 1, wherein the polymer which contains the polymerizable monomer of general formula (2) contains from 10 to 95 mol % of said monomer with respect to the total mols of the monomer component in the polymer.

11. The liquid developer as claimed in claim 1, wherein the amount of chloromethylstyrene in the polymer which contains the polymerizable monomer of general formula (2) is from 1 to 10 mol % with respect to the mols of polymerizable monomer of general formula (2).

12. The liquid developer as claimed in claim 1, wherein the amount of chloromethylstyrene in the polymer which contains the polymerizable monomer of general formula (2) is from 3 to 7 mol % with respect to the mols of polymerizable monomer of general formula (2).

* * * * *